US007591687B2

(12) United States Patent
Caveney

(10) Patent No.: US 7,591,687 B2
(45) **Date of Patent: *Sep. 22, 2009**

(54) ANGLED PATCH PANEL WITH PITCHED CONNECTOR ALIGNMENT

(75) Inventor: Jack E. Caveney, Hinsdale, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/114,910

(22) Filed: May 5, 2008

(65) Prior Publication Data

US 2008/0207048 A1 Aug. 28, 2008

Related U.S. Application Data

(63) Continuation of application No. 11/671,557, filed on Feb. 6, 2007, now Pat. No. 7,393,243.

(60) Provisional application No. 60/772,295, filed on Feb. 10, 2006.

(51) Int. Cl.
*H01R 24/00* (2006.01)

(52) U.S. Cl. ..... 439/676; 439/540.1; 439/541.5

(58) Field of Classification Search ..... 439/540.1, 439/541.5, 719, 676; 385/55, 134, 135
See application file for complete search history.

(56) References Cited

U.S. PATENT DOCUMENTS 5,127,082 A 6/1992 Below et al.
5,129,842 A 7/1992 Morgan et al.
6,497,578 B1 12/2002 Kwong et al.
6,537,106 B1 3/2003 Follingstad
6,866,541 B2 * 3/2005 Barker et al. ..... 439/540.1
6,918,786 B2 7/2005 Barker et al.
6,971,909 B2 12/2005 Levesque et al.
6,981,893 B2 1/2006 Barker et al.
7,094,095 B1 8/2006 Caveney et al.
7,112,090 B2 * 9/2006 Caveney et al. ..... 439/540.1
7,311,550 B2 * 12/2007 Hammond et al. ..... 439/540.1
7,357,667 B2 * 4/2008 Clark et al. ..... 439/540.1
2005/0041947 A1 2/2005 Barker et al.
2005/0142910 A1 6/2005 Levesque et al.
2005/0142932 A1 6/2005 Levesque et al.
2005/0185912 A1 8/2005 Levesque et al.

* cited by examiner

*Primary Examiner*—Tho D Ta
*Assistant Examiner*—Travis Chambers
(74) *Attorney, Agent, or Firm*—Robert A. McCann; Christopher S. Clancy

(57) ABSTRACT

A patch panel mountable to a network rack is provided. The patch panel may include a frame with first and second mounting portions that are each located at opposite longitudinal ends of the frame. The frame may also include a first panel section adjacent to the first mounting portion and a second panel section adjacent to the second mounting portion. The first and second panel sections may be angled relative to each other. Additionally, the first panel section may include a first row of connector openings aligned along a first pitch line, with the first pitch line preferably being angled relative to the longitudinal length of the first panel section. Similarly, the second panel section may include a second row of connector openings aligned along a second pitch line, with the second pitch line preferably being angled relative to the longitudinal length of the second panel section.

21 Claims, 5 Drawing Sheets

ANGLED PATCH PANEL WITH PITCHED CONNECTOR ALIGNMENT

CROSS-REFERENCE TO RELATED APPLICATION

This application is a continuation of U.S. application Ser. No. 11/671,557, filed on Feb. 6, 2007, which claims priority to and incorporates by reference the entirety of U.S. Provisional Application No. 60/772,295, "Angled Patch Panel With Pitched Connector Alignment." filed on Feb. 10, 2006.

FIELD OF THE INVENTION

The present invention relates generally to patch panels for use with communications connectors and, more particularly to an angled patch panel that allows for connector openings aligned along one or more pitch lines.

BACKGROUND

Communications cables connecting multiple devices in a network are frequently routed to a patch panel in a network rack. The network rack, for example, may be located at a central point in a network to allow long runs of communication cables to be brought together in an organized way, and allow easier management and/or connection to other network devices, such as routers and switches.

A recent improvement to patch panels has been to introduce one or more angles in the front face of the panel. The present application incorporates by reference in its entirety U.S. Pat. No. 6,981,893, issued Jan. 3, 2006, entitled "Angled Patch Panel With Cable Support Bar For Network Cable Racks." The angled panel design provides for improved cable management and eliminates the need for horizontal cable managers that take up valuable rack space. By eliminating the horizontal cable managers, the patch cables coming out of the patch panel can be safely routed directly into vertical cable managers along the sides of the rack. Further, the angled panel allows the cables to be routed from the patch panel at a smaller angle.

Typical angled patch panels include connector jacks that are all aligned on a horizontal plane that is generally parallel to the long axis of the patch panel. For side-routing, the cables may have a tendency to stack in front of each other (since they're at the same level), which may cause some cables to have to undergo a more significant horizontal bend to avoid other cables. Such a bend can introduce stress to the interface between the patch cable and the connector plug and jack at the patch panel. A trend toward higher frequency twisted pail cable has resulted in an increase in cable diameter. Another factor that has increased the diameter of cables is the introduction of Patch Cord Management Systems which require an additional wire or wires in each patch cord. An increase in patch cable diameter requires more cross-sectional area for the cables in front of a patch panel. Needed is an angled patch panel design that improves side-routing of patch cables.

SUMMARY

In accordance with an illustrative embodiment of the present invention, a patch panel design that improves side-routing of patch cables is provided. According to one embodiment, a patch panel, which is mountable to a network rack, includes a frame that has a first mounting portion and a second mounting portion. The first mounting portion and the second mounting portion may be located at opposite longitudinal ends of the frame. Additionally, the frame may include a first panel section adjacent to the first mounting portion and a second panel section adjacent to the second mounting portion. The first panel section and the second panel section may be angled relative to each other by an obtuse angle between 90° and 180°. Furthermore, the first panel section may include a first row of connector openings aligned along a first pitch line, with the first pitch line preferably being angled relative to the longitudinal length of the first panel section. Likewise, the second panel section includes a second row of connector openings aligned along a second pitch line, with the second pitch line preferably being angled relative to the longitudinal length of the second panel section.

These as well as other aspects and advantages will become apparent to those of ordinary skill in the art by reading the following detailed description, with appropriate reference to the accompanying drawings.

BRIEF DESCRIPTION OF THE DRAWINGS

Embodiments are described below in conjunction with the appended drawing figures, wherein like reference numerals refer to like elements in the various figures, and wherein.

DETAILED DESCRIPTION

Figure 1A:
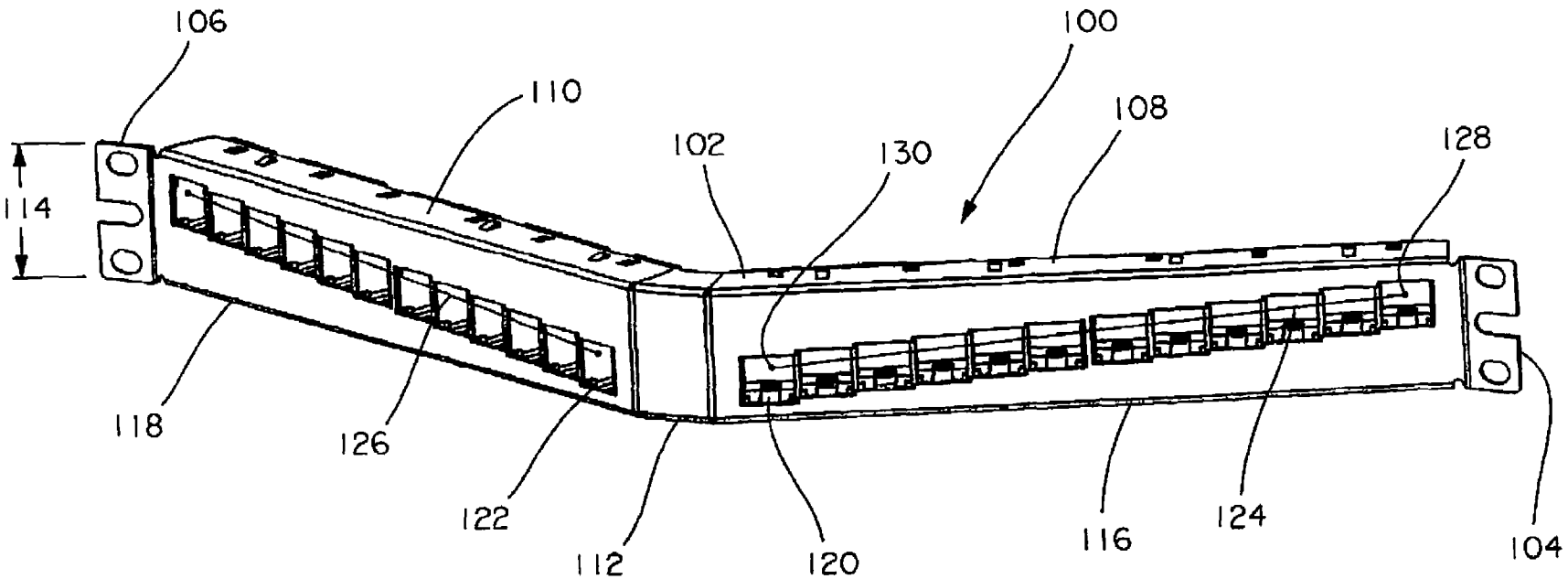
FIG. 1A is a front perspective view of an angled patch panel with a row of connector openings that are aligned along a pitch line.

FIG. 1A is a front perspective view of an angled patch panel 100 (or patch panel, more generally) in accordance with an embodiment of the present invention. The angled patch panel 100 comprises a frame 102 that includes a first mounting portion 104, a second mounting portion 106, a first panel section 108, and a second panel section 110. The frame 102 may also include a center section 112, and may further define a frame height 114.

It should be understood, of course, that this and other arrangements described herein are provided for purposes of example only. As such, those skilled in the art will appreciate that other arrangements and other elements can be used instead, and some elements may be omitted altogether. For instance, the angled patch panel 100 may include additional panel sections.

The first mounting portion 104 and the second mounting portion 106 each allow the angled patch panel 100 to be mounted on a network rack using screws or other attachment mechanisms. The first and second mounting portions 104 and 106 may each be located at opposite longitudinal ends of the frame 102, or at another convenient mounting location. In addition, the first mounting portion 104 and the second mounting portion 106 may each take a variety of configurations. For example, the first and second mounting portions 104 and 106 may each be a panel, bracket, or any other mechanism used to affix the angled patch panel 100 to a network rack. Further, the first and second mounting portions 104 and 106 may each be included as part of the frame 102 (e.g., in a unitary rigid construction), or may each be separate from the frame 102 and attachable via known attachment mechanisms.

As depicted in FIG. 1A, the frame 102 includes at least a first panel section 108 and a second panel section 110. While only two panel sections are shown in FIG. 1A, additional sections may also be included. The frame 102, the first panel section 108, and the second panel section 110 may be in a unitary rigid construction. The first panel section 108 may be adjacent to the first mounting portion 104, and the second panel section 110 may be adjacent to the second mounting portion 106. Further, the first panel section 108 may define a first panel longitudinal length 116, and the second panel section 110 may define a second panel longitudinal length 118. Additionally, the first panel section 108 and the second panel section 110 are angled relative to each other, preferably at an obtuse angle (between 90° and 180°). The frame 102 may also include a center section 112. The center section 112 is the location where the first panel section 108 and the second panel section 110 come together. The center section 112 is illustrated as being a flat section, but it could alternatively be pointed, such as the junction of two angled panel sections or some other configuration known to those skilled in the art. If the angled patch panel 100 includes more than two panel sections, then additional center sections may be included.

Figure 2D:
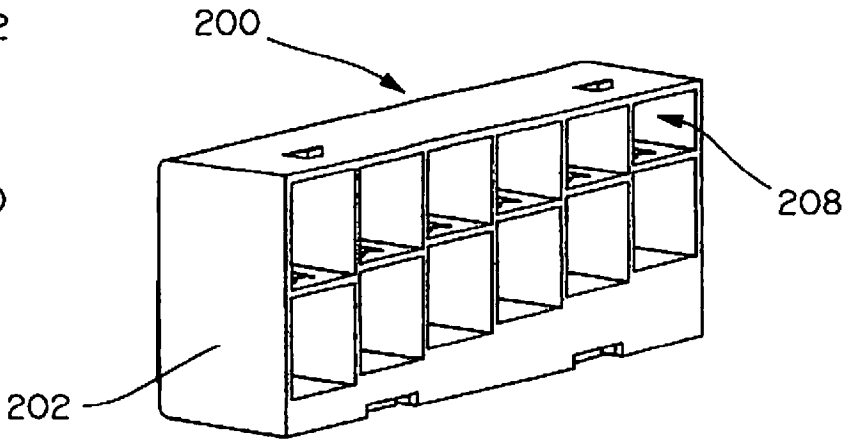
FIGS. 2A, 2B, 2C, 2D, and 2E depict various perspectives of an insert module.
Figure 2E:
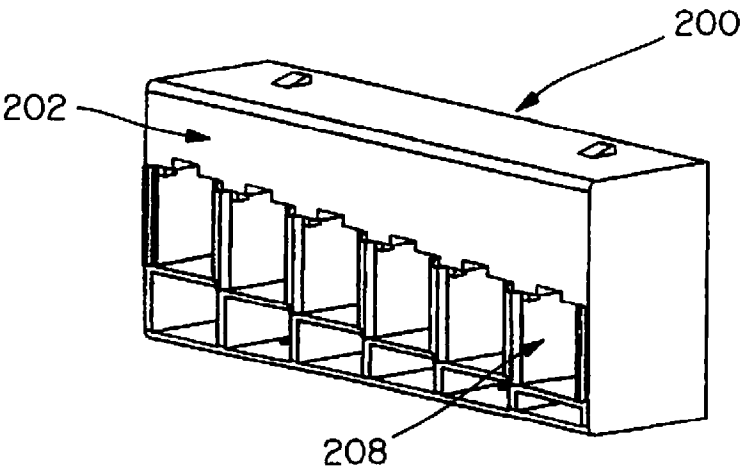
Figure 2A:
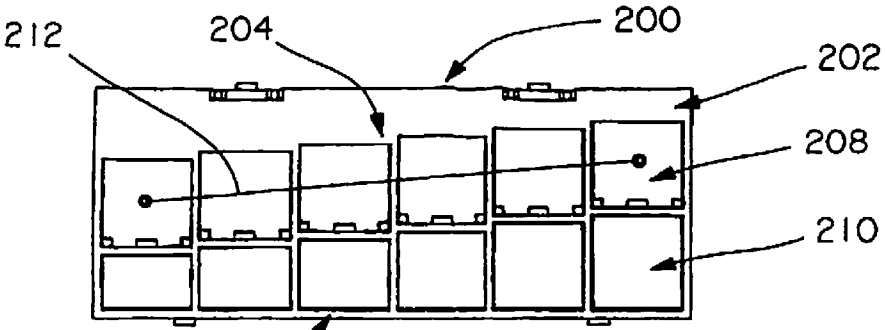
Figure 2B:
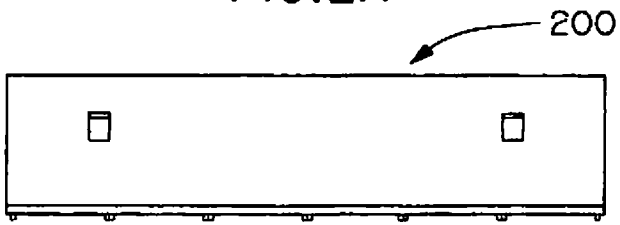
Figure 2C:
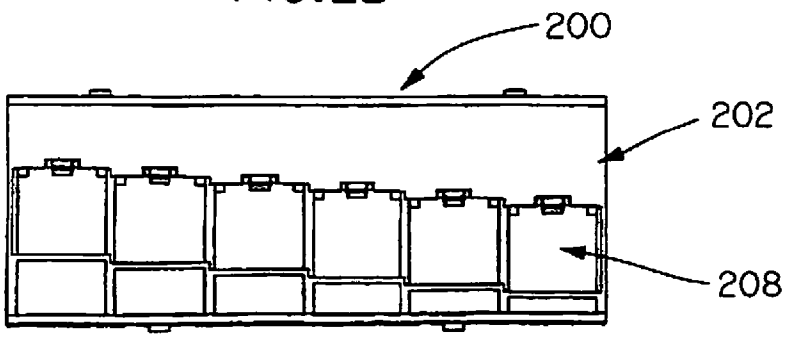

The first panel section 108 may include a first row of connector openings 120. The first row of connector openings 120 may take any of a variety of configurations. For instance, the first row of connector openings 120 may take the form of one or more insert modules. FIGS. 2A, 2B 2C, 2D, and 2E depict various perspectives of an insert module 200. FIG. 2A depicts a front view of the insert module 200, FIG. 2B depicts a top view, FIG. 2C depicts a rear view, and FIGS. 2D and 2E each depict perspective views of the insert module 200. As shown in FIG. 2A, the insert module 200 includes an insert frame 202, a series of connector module mounting openings 204, and a corresponding series of pitched raises 206. A given connector module mounting opening 208 may be adaptable to receive a connector (not depicted). Further, a given pitched raise 210 may elevate the corresponding connector module mounting opening 208 by a given height along the first panel section 108. The height of each adjacent pitched raise in the series of pitched raises 206 may be ascending or descending, thereby creating an alignment for the series of connector module mounting openings 204 that defines a pitch line 212. By uniformly varying the differences in height between adjacent pitched raises, various alignments may be created (i.e., various pitch line angles may be created). Further, rather than the first row of connector openings 120 taking the form of one or more insert modules, a series of connector module mounting openings (not depicted) may be built directly onto the first panel section 108.

Figure 1B:
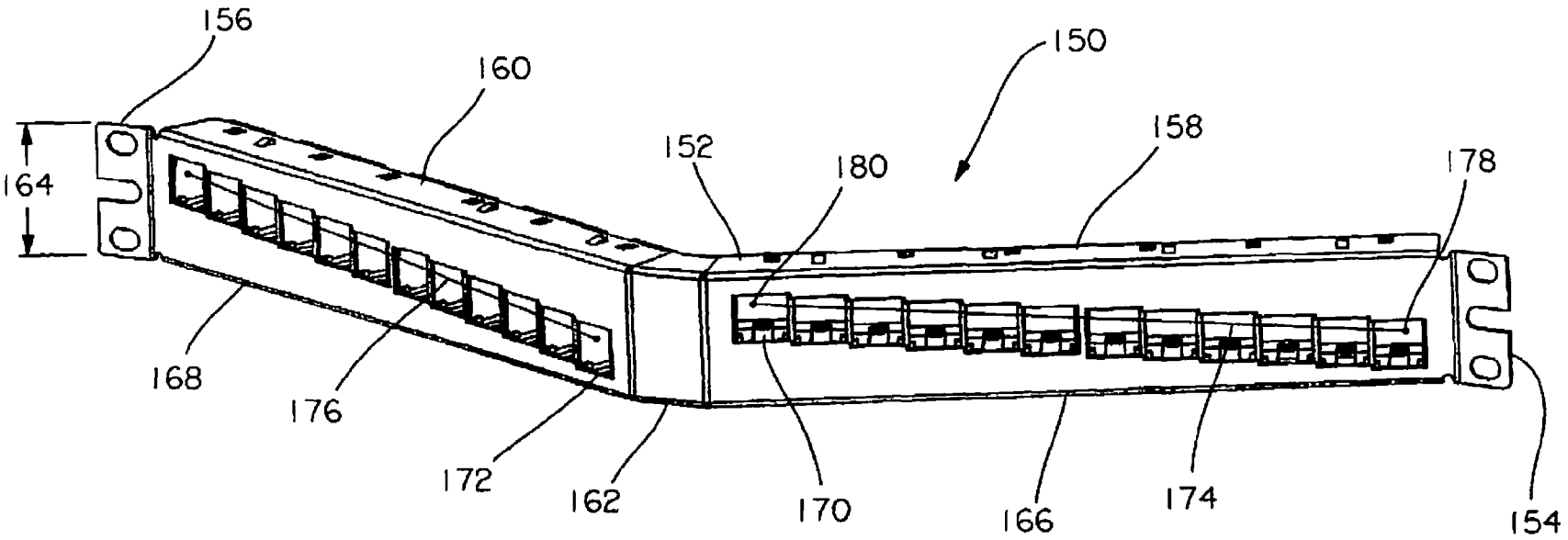
FIG. 1B is a front perspective view of an angled patch panel with a row of connector openings having an alternative pitch arrangement to that shown in FIG. 1A.
Figure 1C:
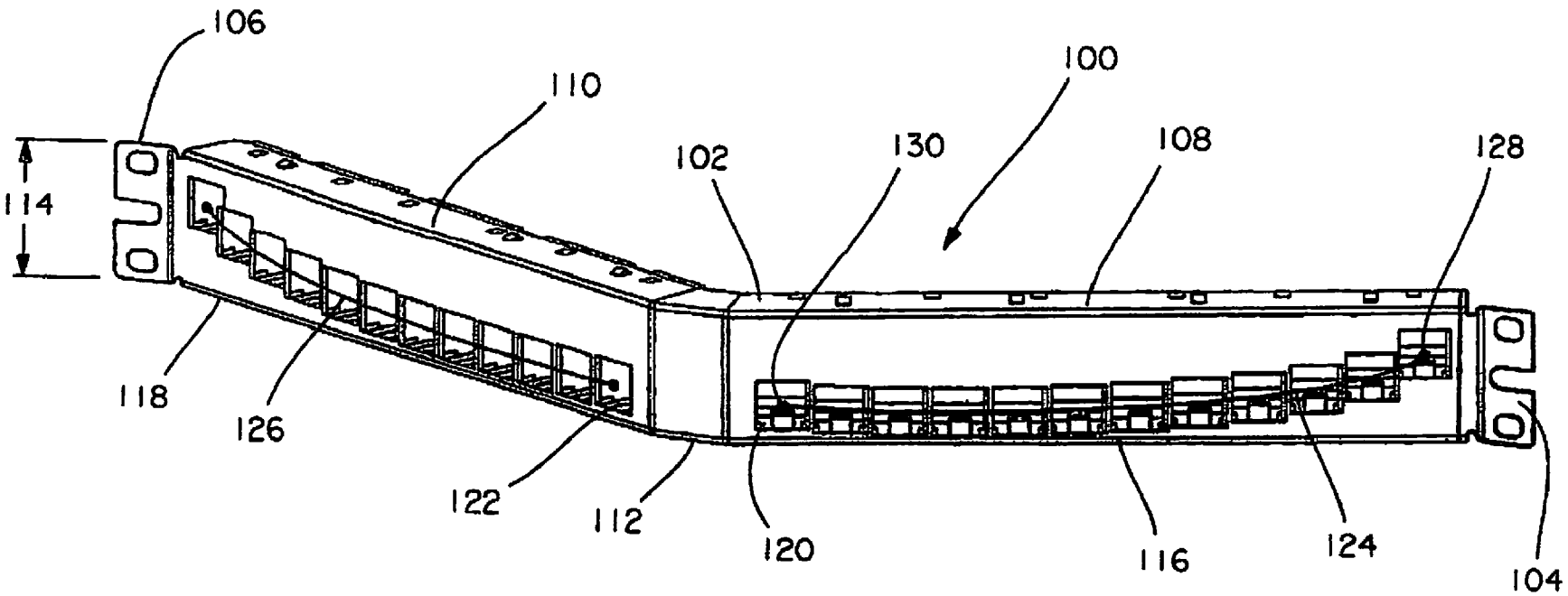
FIG. 1C is a front perspective view of an angled patch panel with a row of connector openings having an alternative pitch arrangement to that shown in FIG. 1A.

As depicted in FIG. 1A, the first row of connector openings 120 may be aligned along a first pitch line 124. The first pitch line 124 is preferably not parallel to the first panel longitudinal length 116, and may either be straight (strictly linear) or curved. Further, the first pitch line 124 may be pitched either upwards or downwards. In the embodiment shown in FIG. 1A, the first row of connector openings 120 is illustrated with each successive connector opening in the row located further away from the center section 112 and aligned in an upward pitch (or downward pitch if taken from the perspective of each successive connector opening in the row located further away from the first mounting portion 104). To define an upward pitch, the first pitch line 124 may include a first end 128 and a second end 130, with the first end 128 being longitudinally closer to the first mounting portion 104 than the second end 130. According to an upward pitch, the first end 128 is higher than the second end 130 with respect to the frame height 114. Alternatively, as depicted in FIG. 1B, which illustrates an angled patch panel 150 that defines a frame height 164, a first row of connector openings 170 is aligned along a first pitch line 174 that has a downward pitch moving away from the center section 162. To define a downward pitch, the first pitch line 174 may include a first end 178 and a second end 180, with the first end 178 being longitudinally closer to a first mounting portion 154 than the second end 180. According to a downward pitch, the first end 178 is lower than the second end 180 with respect to the frame height 164.

Additionally, the first panel section 108 may include more than one row of connector openings. Each row of connector openings may be aligned along a respective pitch line. The respective pitch line of each row is preferably not parallel to the first panel longitudinal length 116. Further, the respective pitch line of each row may be parallel to one another. Additionally, the respective pitch line of each row may either have an upward or downward pitch moving away from the center section 112, and may either be straight or curved. Preferably, the alignment (or angle) of each respective pitch line is maximized to optimize side-routing of patch cables.

Like the first panel section 108, the second panel section 110 includes a second row of connector openings 122 aligned a second pitch line 126. The second panel section 110, the second row of connector openings 122, and the second pitch line 126 may each be arranged in a similar manner as described above with respect to the first panel section 108, the first row of connector openings 120, and the first pitch line 124, respectively.

The first pitch line 124 and the second pitch line 126 may each have an upward or downward pitch moving away from the center section 112. Additionally, the first pitch line 124 may be pitched at the same angle as the second pitch line 126.

Figure 3B:
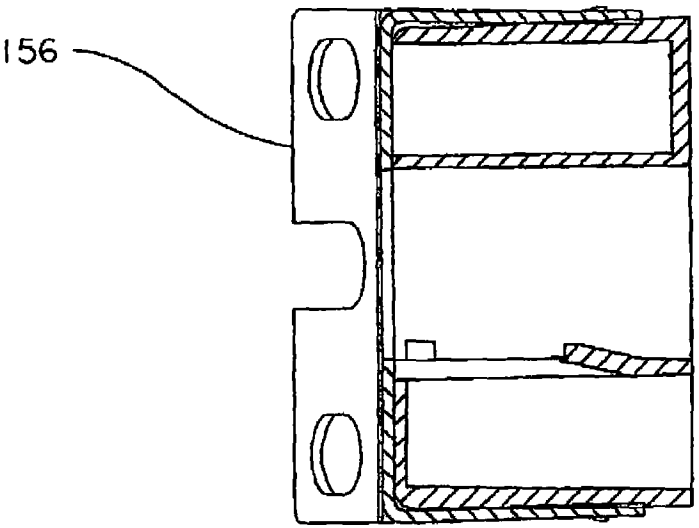
FIG. 3B is a cross-sectional view of the patch panel shown in FIG. 3A, taken along the section line B-B.
Figure 3A:
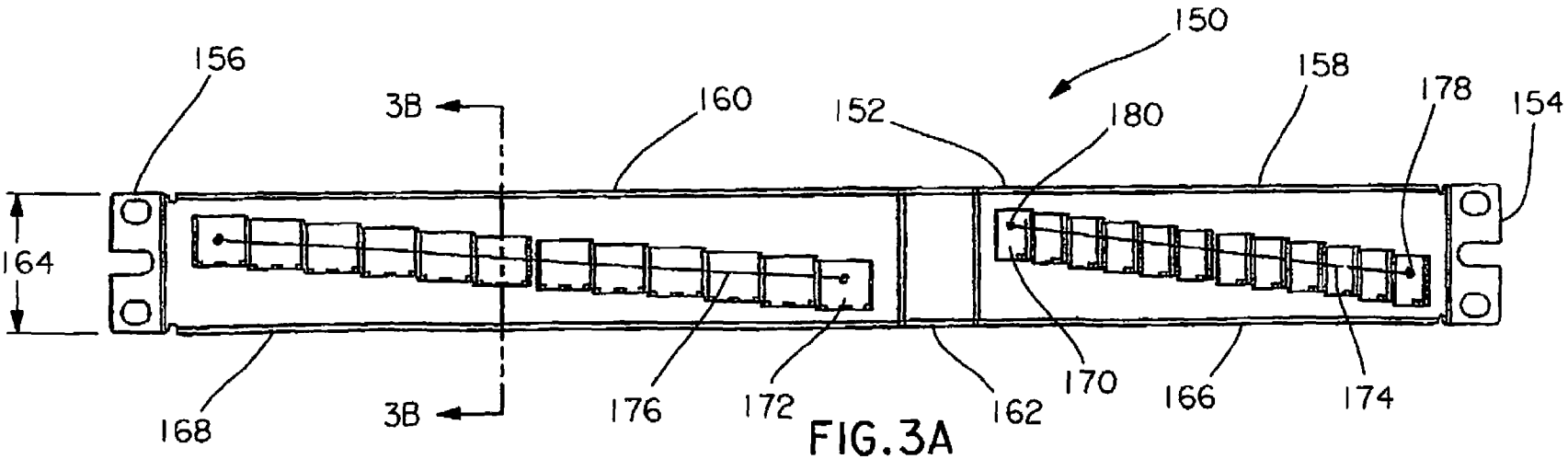
FIG. 3A is a front view of the patch panel as shown in FIG. 1B looking from the direction perpendicular to the left panel section.

To further illustrate. FIGS. 3A and 3B depict a cross-sectional view of the patch panel 150. Specifically, FIG. 3A is a front view of the patch panel 150 looking from the direction perpendicular to the second panel section 160, and FIG. 3B is a cross-sectional view of the patch panel 150, taken along the section line B-B.

In the embodiments shown, the frame 102, the first mounting plate 104, the second mounting plate 106, the first panel section 108, the second panel section 110 and the center section 112 may each be constructed of one or more metal pieces. The insert module 202 may be primarily plastic. Alternative materials known to those skilled in the art can also be used.

Exemplary embodiments of the present invention have been described above. Those skilled in the art will understand, however, that changes and modifications may be made to the embodiments described without departing from the true scope and spirit of the present invention, which is defined by the claims.

The invention claimed is:

1. A patch panel mountable to a network rack, comprising:

a frame having a first mounting portion and a second mounting portion, wherein the first mounting portion and the second mounting portion are located at opposite longitudinal ends of the frame;

wherein the frame includes a first panel section adjacent to the first mounting portion and a second panel section adjacent to the second mounting portion, wherein the first panel section and the second panel section are angled relative to each other;

wherein the first panel section comprises a first row of connector openings aligned along a first pitch line, wherein the first pitch line is at a first acute angle with respect to the longitudinal length of the first panel section, and wherein the first pitch line and the longitudinal length of the first panel section are coplanar; and wherein the second panel section comprises a second row of connector openings aligned along a second pitch line, wherein the second pitch line is at a second acute angle with respect to the longitudinal length of the second panel section, and wherein the second pitch line and the longitudinal length of the second panel section are coplanar.

2. The patch panel of claim 1, wherein the first pitch line is pitched at the same angle as the second pitch line.

3. The patch panel of claim 1, wherein the first and second rows of connector openings span more than three-fourths of the entire length of the respective first and second panel sections.

4. The patch panel of claim 1, wherein the frame, first panel section, and second panel section are in a unitary rigid construction.

5. The patch panel of claim 1, wherein the first and second pitch lines are straight.

6. The patch panel of claim 1, wherein the first and second pitch lines are curved.

7. The patch panel of claim 1, wherein the first pitch line has an upward pitch moving away from the first mounting portion.

8. The patch panel of claim 1, wherein the first pitch line has a downward pitch moving away from the first mounting portion.

9. The patch panel of claim 1, wherein at least one connector opening in the first row comprises a connector module mounting opening adaptable to receive a connector.

10. The patch panel of claim 1, wherein at least one connector opening in the first row comprises an insert module that includes a connector module mounting opening.

11. The patch panel of claim 1, wherein the first panel section and the second panel section are angled relative to each other by an obtuse angle.

12. The patch panel of claim 1, wherein the first and second panel sections each include more than one row of connector openings, wherein each row of connector openings on the respective first and second panel sections is aligned along a respective pitch line, wherein the respective pitch line of each row on the first panel section is not parallel to the longitudinal length of the first panel section, and wherein the respective pitch line of each row on the second panel section is not parallel to the longitudinal length of the second panel section.

13. The patch panel of claim 12, wherein the respective pitch line of each row on the first panel section is parallel to one another, and wherein the respective pitch line of each row on the second panel section is parallel to one another.

14. The patch panel of claim 12, wherein the respective pitch line of each row on the respective first and second panel sections is straight.

15. The patch panel of claim 12, wherein the respective pitch line of each row on the respective first and second panel sections is curved.

16. The patch panel of claim 1, wherein the frame defines a frame height, wherein the first pitch line comprises a first end and a second end, wherein the first end is longitudinally closer to the first mounting portion than the second end, and wherein the first end is higher than the second end with respect to the frame height.

17. The patch panel of claim 16, wherein the second pitch line comprises a third end and a fourth end, wherein the third end is longitudinally closer to the second mounting portion than the fourth end, and wherein the third end is higher than the fourth end with respect to the frame height.

18. The patch panel of claim 16, wherein the second pitch line comprises a third end and a fourth end, wherein the third end is longitudinally closer to the second mounting portion than the fourth end, and wherein the third end is lower than the fourth end with respect to the frame height.

19. The patch panel of claim 1, wherein the frame defines a frame height, wherein the first pitch line comprises a first end and a second end, wherein the first end is longitudinally closer to the first mounting portion than the second end, and wherein the first end is lower than the second end with respect to the frame height.

20. The patch panel of claim 19, wherein the second pitch line comprises a third end and a fourth end, wherein the third end is longitudinally closer to the second mounting portion than the fourth end, and wherein the third end is higher than the fourth end with respect to the frame height.

21. The patch panel of claim 19, wherein the second pitch line comprises a third end and a fourth end, wherein the third end is longitudinally closer to the second mounting portion than the fourth end, and wherein the third end is lower than the fourth end with respect to the frame height.

* * * * *